United States Patent [19]

Magoni et al.

[11] Patent Number: 4,622,893

[45] Date of Patent: Nov. 18, 1986

[54] HIGH-SPEED AUTOMATIC HOOPING DEVICE

[75] Inventors: Pascal Magoni, Fegerheim; Bernard Jean-Pierre, Strasbourg; Pascal De Guglielmo, Troyes, all of France

[73] Assignee: Brasseries Kronenbourg (S.A.), Strasbourg, France

[21] Appl. No.: 759,075

[22] Filed: Jul. 25, 1985

[30] Foreign Application Priority Data

Jul. 27, 1984 [FR] France ..... 84 12114

[51] Int. Cl.[4] ..... B65B 13/18

[52] U.S. Cl. ..... 100/2; 53/589; 100/4; 100/7

[58] Field of Search ..... 100/2, 4, 7, 25, 26; 53/589, 590

[56] References Cited

U.S. PATENT DOCUMENTS 3,568,591 3/1971 Dunlap ..... 100/7

4,416,196 11/1983 Yamada ..... 100/7

FOREIGN PATENT DOCUMENTS 654021 12/1937 Fed. Rep. of Germany ..... 100/7

*Primary Examiner*—Billy J. Wilhite

*Attorney, Agent, or Firm*—Erwin S. Teltscher

[57] ABSTRACT

An automatic high speed hooping station for horizontal hooping of diverse packages contains a barrier device to effect entry of packages, one by one, along their direction of travel, followed by a conveyance assembly. The conveyance assembly includes a rolling double transfer belt, followed in turn by a take-up table provided with an optical detector at its extremity. Along the conveyance assembly there moves reciprocally a push- and loading device for being introduced into an upward travel and holding assembly formed by an ascending platform, a holder trapdoor in a hooping position in an arc of a hooping device, and an upper package discharge device operating by lateral disengagement from a pile of the packages onto an exit ramp. The discharge device includes a push arm articulatably mounted around a point actuated by a cam. The assembly may be moved in translation under the surveillance of a detector.

10 Claims, 16 Drawing Figures

HIGH-SPEED AUTOMATIC HOOPING DEVICE

The invention relates to a station for automatic horizontal hooping of any type of package at high speed, and more generally for integrating, but not exclusively, in a final position, and in an automatic hooping station an automated line of groups of very popular consumer packages having different respective contents.

Packages needing peripheral bands require, in addition to the packaging operation, and subsequent placement of the packages into containers, boxes, or other conditioners, whether closed or partially open, releasably into thermally protective housings, enveloping means and others, a complementary operation called "hooping" which consists in looping the band around the body of the package, to bend the band into a loop, and to tighten and solder the looped band, all in an endeavor to maintain the tightness of the resulting loop at the desired value.

Such a band represents an important advantage from all points of view, i.e. cohesion and solidity. It brings about beyond the technical complexity of automatic packaging in a production line, in a further, and not hitherto perfectly automated phase, a slowing of the production rate, and certain technical delays due to functional requirements.

An industrial, production-line type hooping operation, includes, beyond forward and recapture conveyors, an association of mechanical subassemblies so disposed and activated as to result in a band emplacement without any outside intervention.

With regard to the foregoing, two types of machines actually exist which permit automatic band placement.

In the first type one deals with a conventional hooping device, which is integrated into a packaging line. This hooping device, the operation of which is coordinated with that of the production line, is adapted to the particular shape of the packages: parallelepipedes, cylinders, semi-cylinders, with or without grooves.

The hooping devices employed actually use an arc around which the hooping takes place. The product arrives below the arc perpendicularly to the plane of its aperture. It stops below the arc, in a hooping position, and receives the band. The band is passed to the interior of the arc in a hollow frame open on its interior perimeter.

The free extremity, after having encircled the body of the package, enters into the head of the hoop. The so constituted loop is size-reduced by exerting tension on its free extremity. It is released from the arc and encircles the package in the form of a loose loop. The band continues to be tensioned up to the desired tension, and subsequently a blockage operation, a soldering operation, separation into successive descents, and discharge of the package succeed one another until transport resumption for palletisation.

In another and less efficient device the band is wound around the package by the forward movement of its body along two jaw-type unwinders disposed on respective sides of the transport belt feeder. After a displacement slightly greater than the length of the package, the progress of the package is blocked by immovable stops disposed at the output of the hooping subassemblies. The jaws are again closed along the rear face of the package, and are crossed over so as to impart tension to the band, and to immobilize it by welding. The hooping speed of this type of device will be found to be quickly limited due to the large number of package encircling movements around the package, which are necessary, and its duration of immobilizing the stop as a result of the aforesaid tightening process.

In order to increase the rate of hooping, it is not only necessary to make use of a hooping device or rapidly operating hooping devices, but it is neccessary first and foremost to suppress as much as possible any dead times, which are intertwined with the manipulativedisplacement or gripping of the package prior to the hooping operation proper.

One of the objects of the invention consists precisely in perceptively increasing the production rate of the materials which have up to the present been employed in automated hooping lines.

Another object of the invention is the constant search to gain floor space.

A supplemental object of the invention relates to total automation not requiring any supervision.

A last object relates to the facility and rapidity of intervention in case of any fault or malfunctioning. The particular characteristics of the mechanical linkages and holding means for the hooping device on the frame support of the hooping station ensure a minimum operational down-time of the hooping line in the case of a fault.

It is the general object of the invention to offer industrialists the possibility of an increase in productivity by proposing to the enterprises concerned a high speed hooping line.

The application of the invention to a great multiplicity of packages actually utilizing one or several hoops of sheet-metal type strips will be noted. Practically all products manufactured in a certain manner are finally offered for sale in this type of package. The hoops convey in effect a supplementary and proper mechanical strength of the package, so that a good general constitution and structure of the package can be properly claimed.

Due to the employment of strip hooping having become very prevalent, the output rate of an automatic hooping line is becoming as important as that of a packaging or conditioning line.

The invention proposes an interesting solution due its possibilities of high speed and integrated automation, applying even for special hooping applications, for example precision hooping, or hooping operations where the hooping strip must nestle within deformable recesses.

For this purpose, the invention relates to a high speed horizontally operating automated hooping station for all types of packages, characterized that it is formed by conveyance means constituted by a barrier device for individualizing and introducing the packages, an upward travel and holding device which traverses vertically a horizontal hooping device and operates by empilement; the station also includes a discharge device for the hooped package which is disposed in an upper location above the pile.

The specific advantages of the empiling station, according to the invention, are more specifically restated in what follows:

high hooping speed attaining thirty packages per minute;

reduced floor space, as the station itself only occupies an area of 2.5 by 2 m;

the entire operation does not require any constant supervision whatever;

the support for the hooping device is implemented so as to be entirely stationary, so that it can be replaced in a minimum time in the case of malfunction;

it is universally applicable to most diverse packages; it is in fact sufficient if the packages are adapted to be piled up, namely that its bottom be not deformed, so that its top should have a shape complementary to its bottom;

minimum consumption of hooping strip material.

The detailed characteristics of the invention and other advantages will appear upon reading the description, which provides non-limiting examples of an embodiment, and with reference to the drawing accompanying it, in which.

Figure 1:
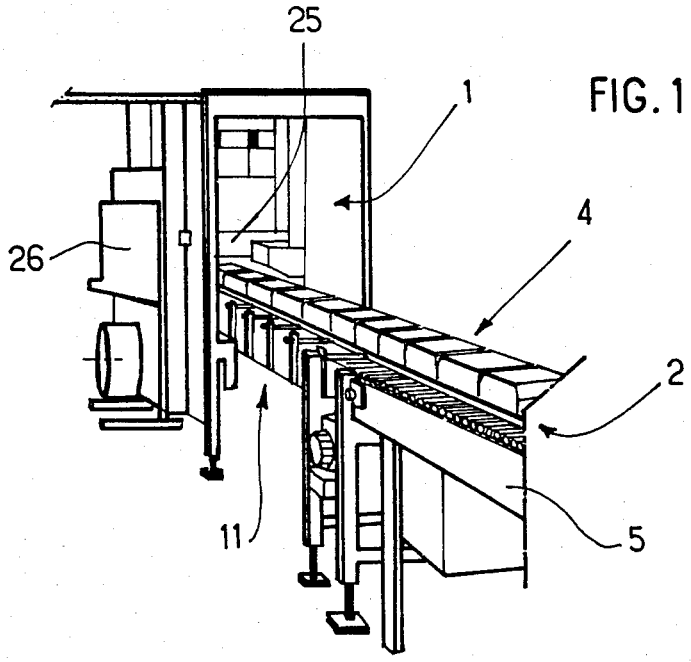
FIG. 1 is a general perspective view of the station and the installation showing more particularly the arrival of the line in the hooping station.
Figure 3:
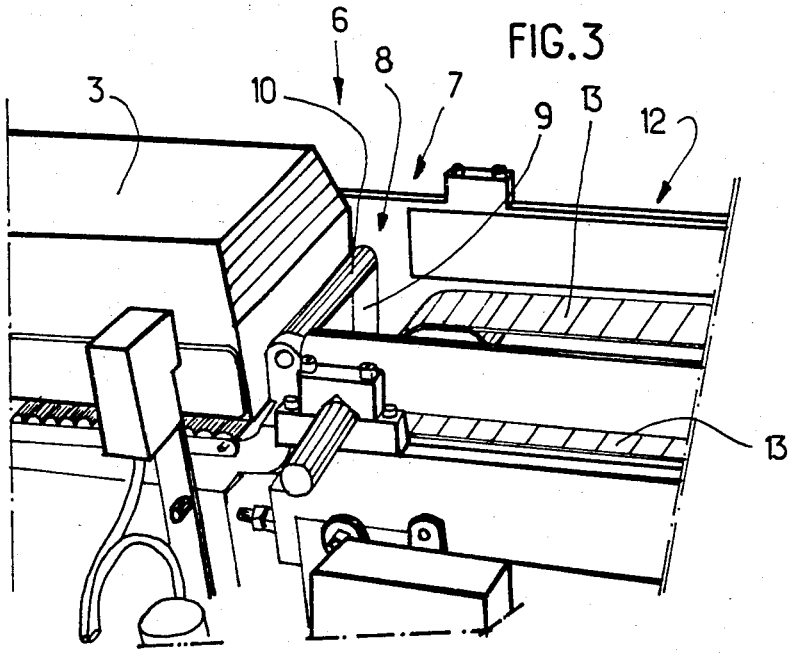
FIG. 3 is a perspective view of the port of entry with its barrier mechanism.
Figure 2:
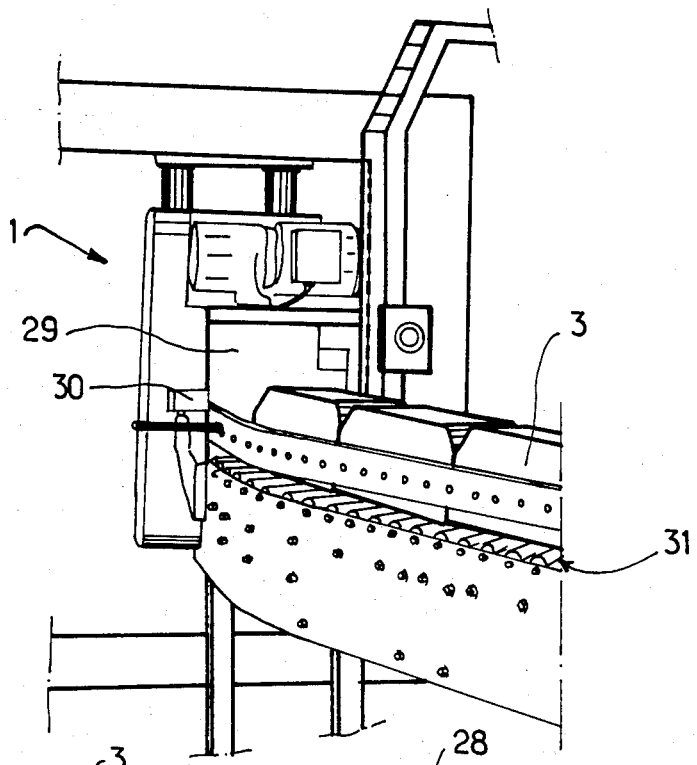
FIG. 2 is a general perspective view of the installation assembly, and refers in particular to the discharge from the hooping station.
Figure 6:
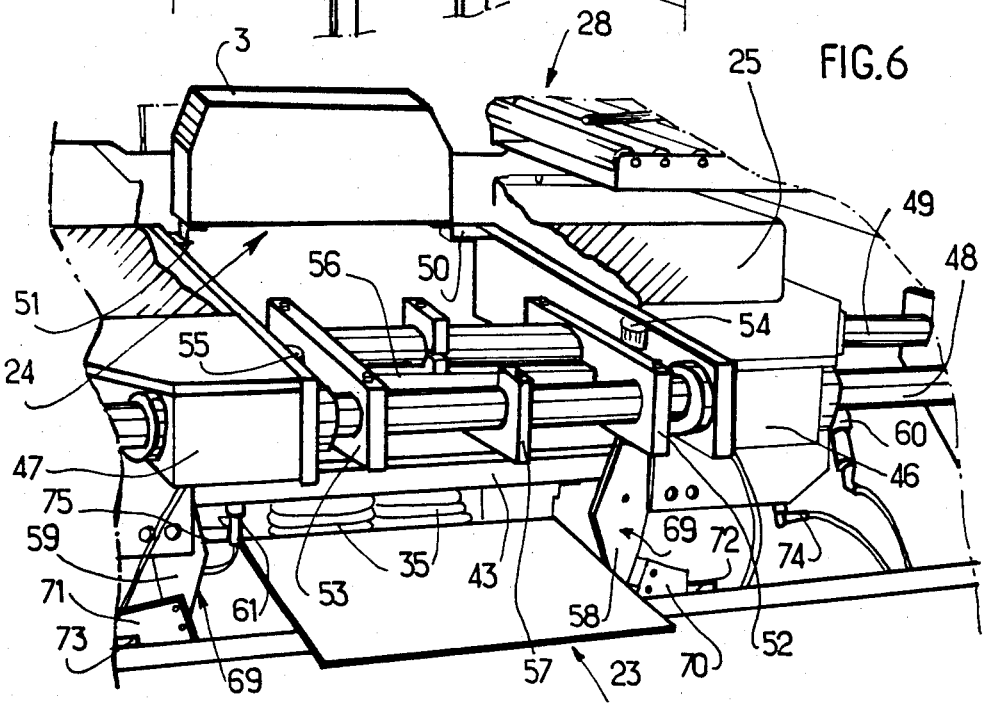
FIG. 6 is a general perspective view of the subassemblies controlling movement of the jaws of the trap door holder.
Figure 4:
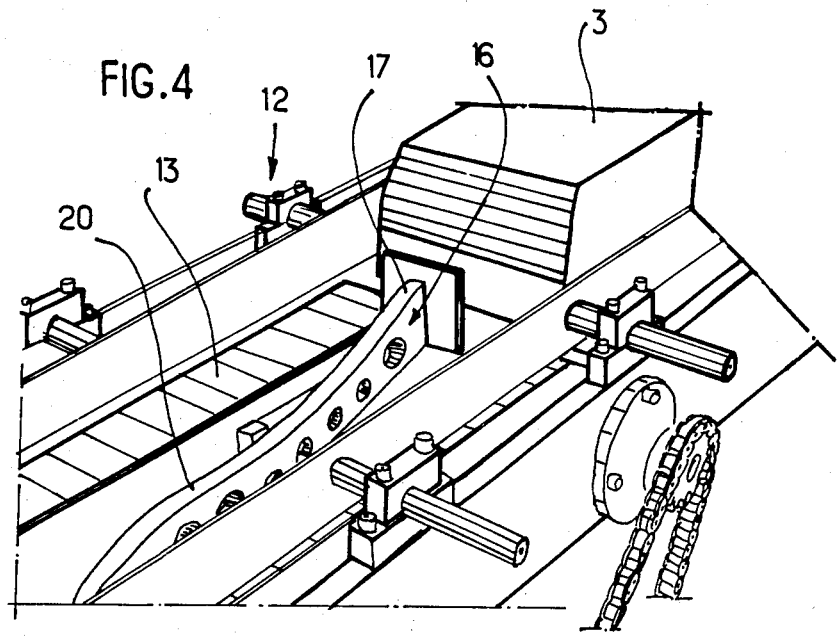
FIG. 4 is a perspective view of the assembly supplied to the platform.
Figure 5:
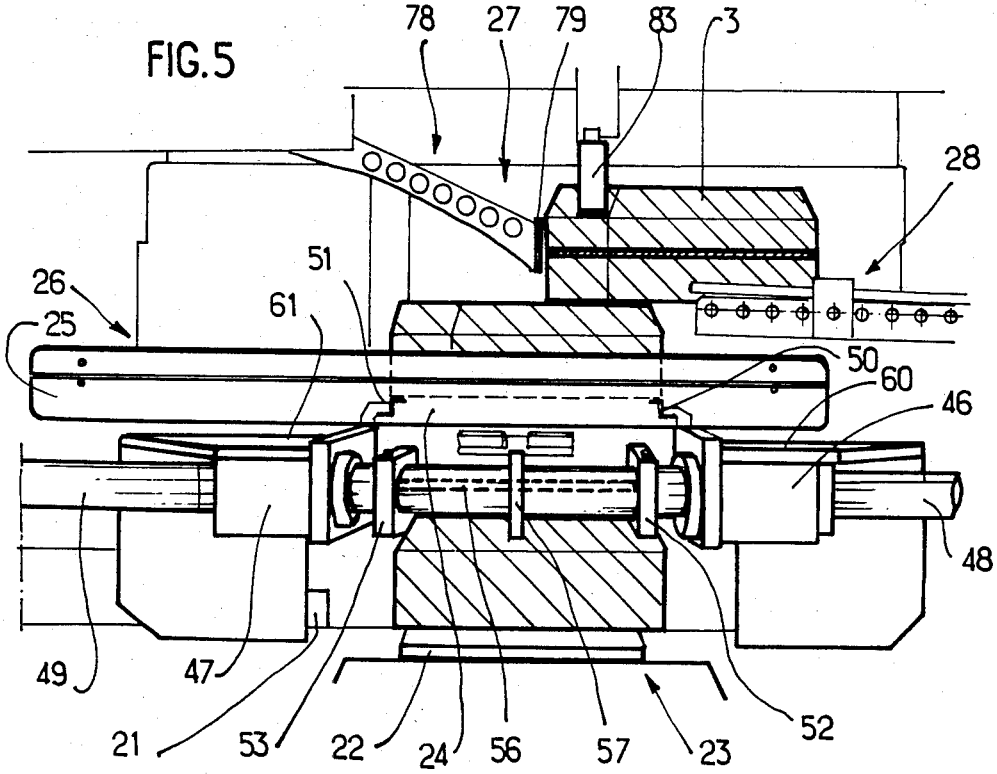
FIG. 5 is a view of the central part of the hooping station assembly at the level of the hooping zone with a schematic indication of the jaws of the trap door holder.
Figure 8:
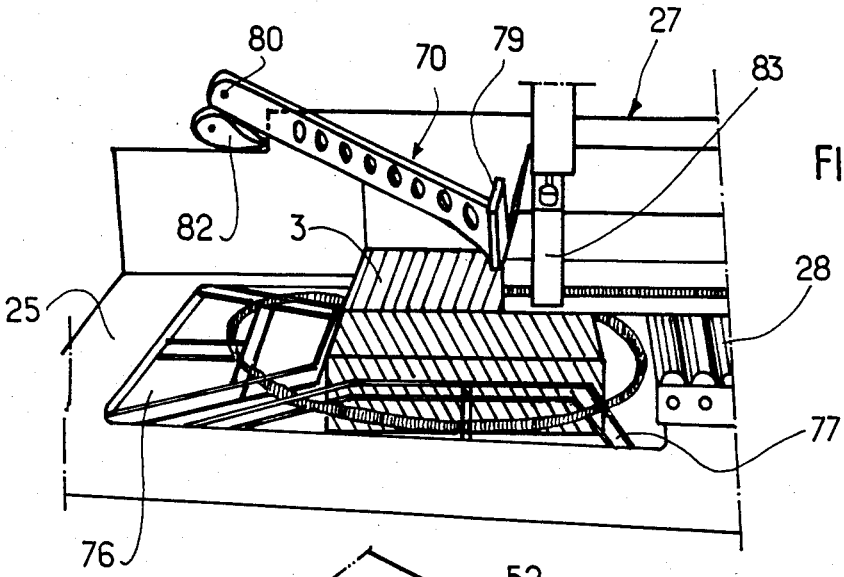
FIG. 8 is a detailed perspective view of the upper part showing the position of the strip and the discharge.
Figure 7:
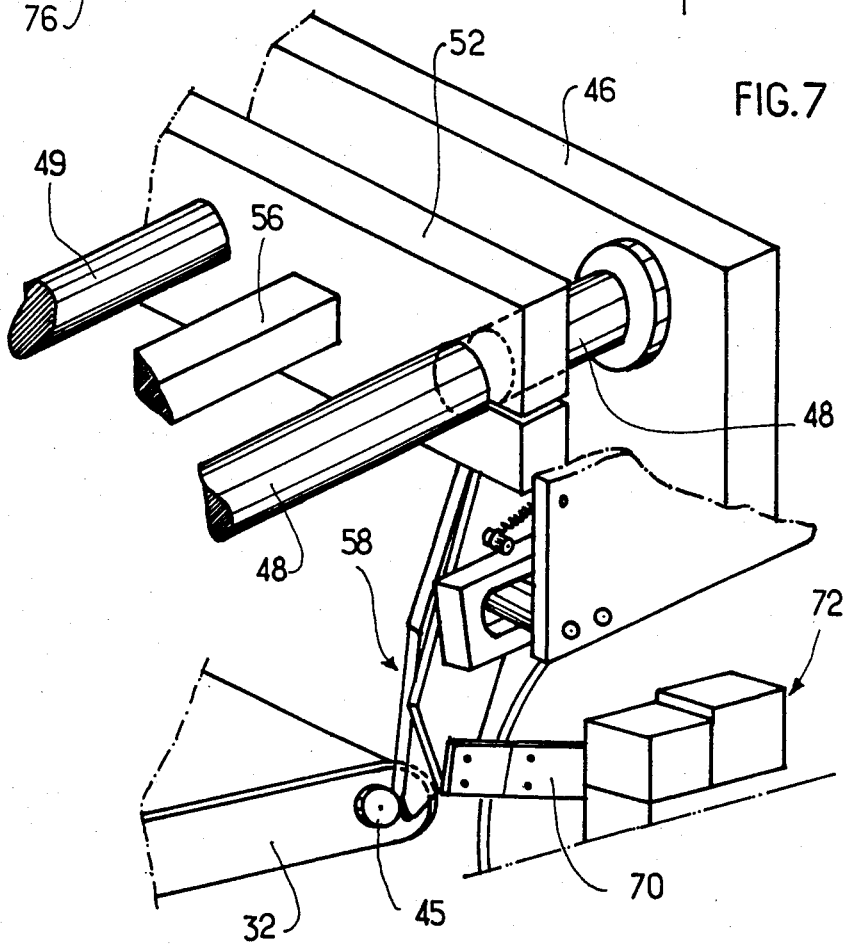
FIG. 7 is a schematic detailed view of one of the control means for the trap door holder in an open position.

There is described hereinafter an automated hooping station conforming to the invention which permits high speed hooping of all types of packages, even those formed with deformable grooves in ridges. In this manner, the hooping station according to the invention applies also to cylindrical packages, to small containers, and composite platforms by means of evident adaptations necessitated by the different respective configurations.

The automatic hooping station 1, according to the invention, is inserted into a hooping line embodiment 2 in an end position, before the products are placed on pallets into an individual package.

The packaged products, hereinafter denoted as packages 3, arrive in a continuous train 4, on a conveyor 5, having, for example, rollers and a moving take-up belt up to the hooping station, wherein they are admitted one by one for rapid hooping, made possible by the invention.

The continuous train 4 of the packages is cut at an entry port 6 by a door 7 in the form of barrier means 8 constituted in a conventional manner by a transverse vertically slidable retention element 9 terminated by a roller 10, which facilitates its downward vertical release and blockage movements along its faces before the arrival of the packages, and subsequently breaks up the continuous train 4 into individual movements.

The admission train 11 at the entry port of the hooping station continues toward the hooping zone by a transport mechanism 12 constituted by a double transfer roller belt 13 disposed next to the entry port 7, a take-up table 14, and a reciprocal pushing and loading mechanism 15. The latter is formed by a retractable arm 16 terminated by a pushing plate 17. This arm is entrained for reciprocal to and fro movements by a connecting crank 18 along a sliding rod 19. This arm is mounted for elastic recoil towards the top, and its upper edge 20 has a profile adapted to permit its pivoting into a retracted position until its return by a sole rearward translatory movement so that it can pass under the next package to be pushed.

To assure passage of the pushing arm 16, the take-up table 14 is formed with a straight central longitudinal groove along which the arm 16 is displaced. An optical detector 21 disposed at an extremity of the table 14 furnishes to a central coordinating member the necessary information relating to the presence and passage of the packages in their final position and in the course of loading.

The transport belt 13 carries the package 3 onto the take-up table 14, on which it glides by its momentum, up to a center position, where it is taken up by the pushing arm 16 until its loading on the raised assembly platform 22 and the carriage 23, which constitute the central part of the hooping station, according to the invention.

It will be understood that the course of the arm 16 is controlled in a manner that its advance movement permits the translatory movement of the package 3 on the table 14 onto the platform 22, into the central position up to the complete loading.

The moving chain continues on its upward path by means of a trapdoor carriage 24 to the level of the arc 25 of the hooping device 26, and by the discharge mechanism 27 on the output ramp 28. The discharged packages traverse an exit port 29, including an optical detector 30 commanding the stoppage of the station due to a blockage on the discharge transporter 31 or downstream thereof.

Operation, synchronization and coordination of the different movements and actions are commanded and guided by an automatic programmer of conventional design, which does not form the object of the present invention.

A sole central motor furnishes the kinetic energy required for the various entrainment and blocking movements so as to permit operation of the station according to the invention.

The upward travel assembly and carriage 23 consists, more precisely, of the following elements and means grouped and arranged so as to permit positioning, fixing into a hooping position, and discharge of the packages as quickly as possible, without any dead time resulting in any intermediate movement or position.

Figure 9:
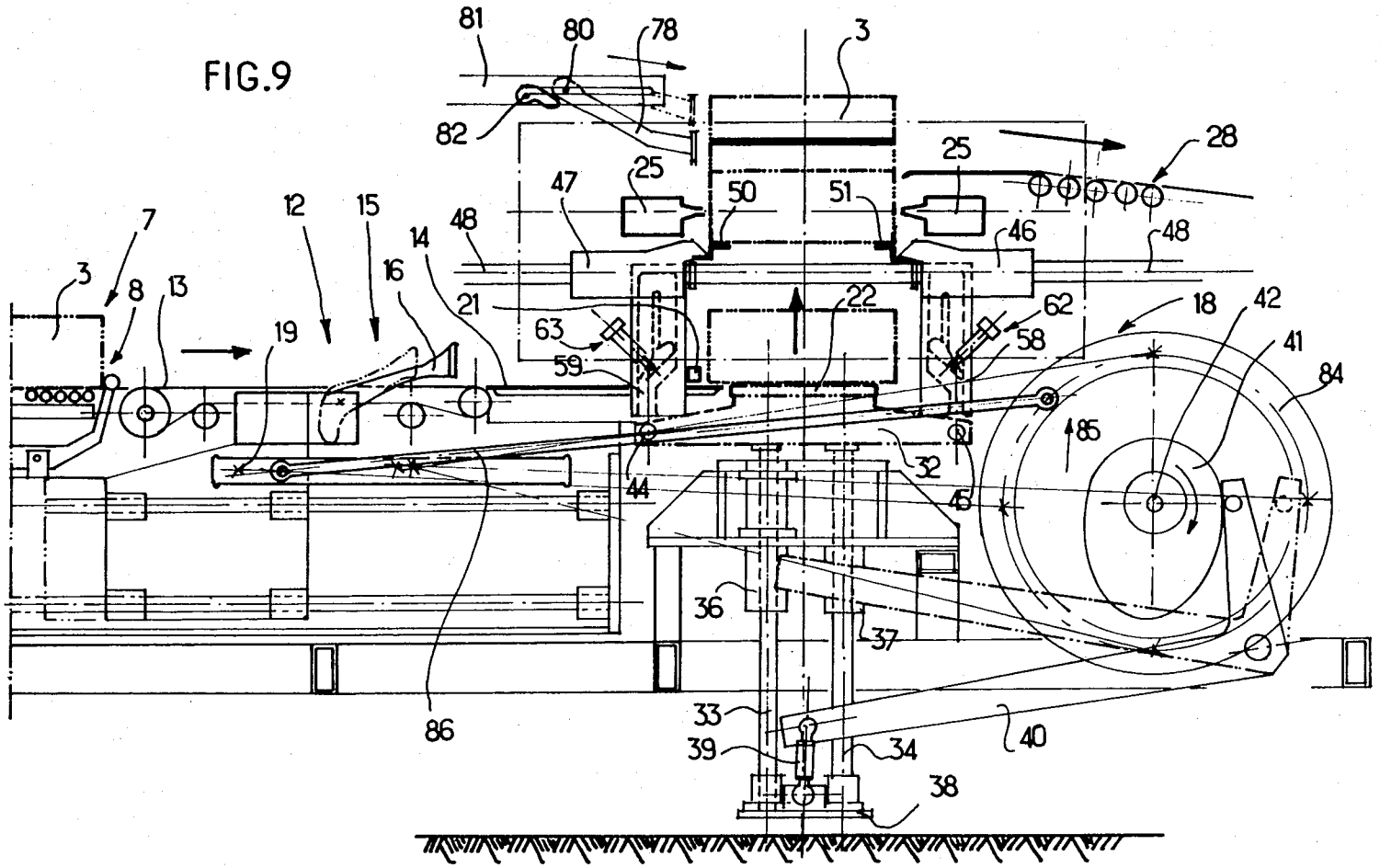
FIG. 9 is a schematic view of the assembly in vertical cross-section, illustrating the control, and the general kinematics of the hooping station, according to the invention.
Figure 10:
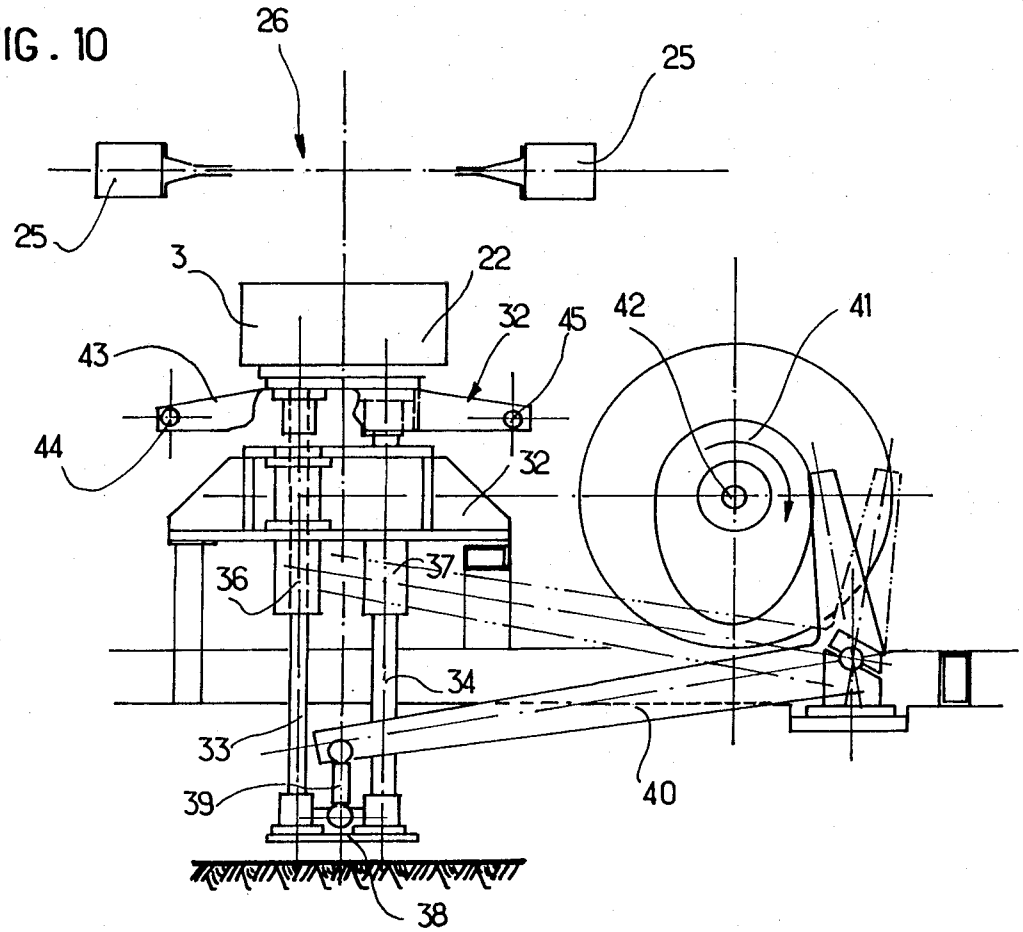
FIG. 10 is a schematic overall view in vertical section of the upward travel and holding assembly, and the mechanical control means for the platform for vertical movements.
Figure 11:
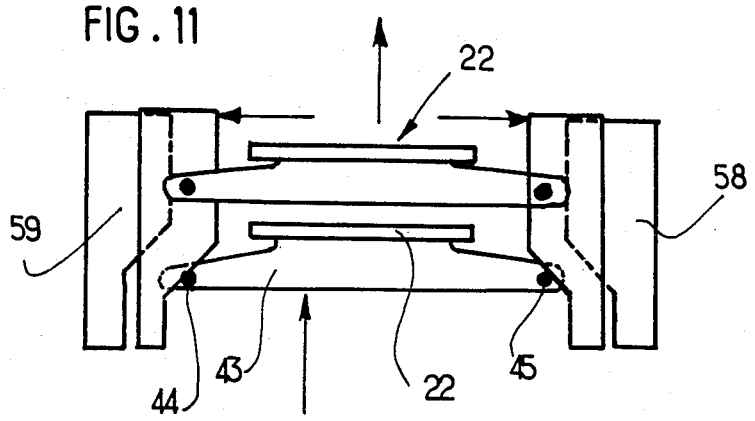
FIG. 11 is a partial schematic dual view of the platform with its control means for the upward travel and holding means before, during, and after its opening.

In this manner, the platform 22 is mounted so as to glide along the supports. It is formed with a thick base 32 connected to two parallel and movable shafts 33 and 34 through the intermediary of a top bellows assembly 35. These shafts form the slide support for the vertically slidable guides 36 and 37. Their lower extremities are joined by a junction plate 38 pivotably connected through a link 39 to an L-shaped crank 40, whose short arm abuts a cam 41 (FIG. 9), in turn mounted on the principal shaft 42 kinematically connected to the sole motor, which, through the intermediary of the cam, provides the drive for the balancing movement.

A transverse spacing bar 43 is mounted rigidly with the base 32 of the platform, and parallel with the plane of its base. This bar which has a length exceeding that of the platform, is formed on each of its extremities with stubs or pins 44 and 45, which cooperate with respective horizontal position-controlling cams, as will be seen hereafter, with a view to open the trapdoor carriage 24. The latter is constituted by two movable members 46 and 47 operating as jaws gliding towards and away from the two guide shafts 48 and 49. The movable members are provided at their respective extremities with support elements 50 and 51 shaped as reverse angle brackets, and wherein the horizontal parts of the angle brackets form together with their counterparts two support surfaces at the entry level of the arc having as its purpose to support the package from below, while being free of any lateral constraints.

The two transverse endplates 52 and 53 are rigidly mounted on the guide shafts 48 and 49 and serve as adjustable end stops for the movable members 46 and 47 through the intermediary of the elastic transverse stoppers 54 and 55 provided thereon.

The adjustable stops 52 and 53 are emplaced in a perfectly symmetrical manner by a format-providing cross-beam 57, defining the median plane of the upward travel and holder assembly 23. In this manner, whenever the format is changed, it is sufficient to replace the format-providing cross-beam by another adapted for respective different dimensions.

The movable elements 46 and 47 are urged towards an open position from the start of the upward movement of the platform by two identical position-controlling cams 58 and 59 hingeably mounted on the lower part of the movable elements. The cams are activated by the studs 44 and 45 located at respective extremities of the space bar 43.

The movable elements 46 and 47 are urged towards a closed position by pneumatic push elements 60 and 61 controlled by automatic programming means in conjunction with detectors, and information provided by synchronization cams mounted on a cam shaft. Closure limits are brought about by the transverse end plate-stops 52 and 53.

Figure 12:
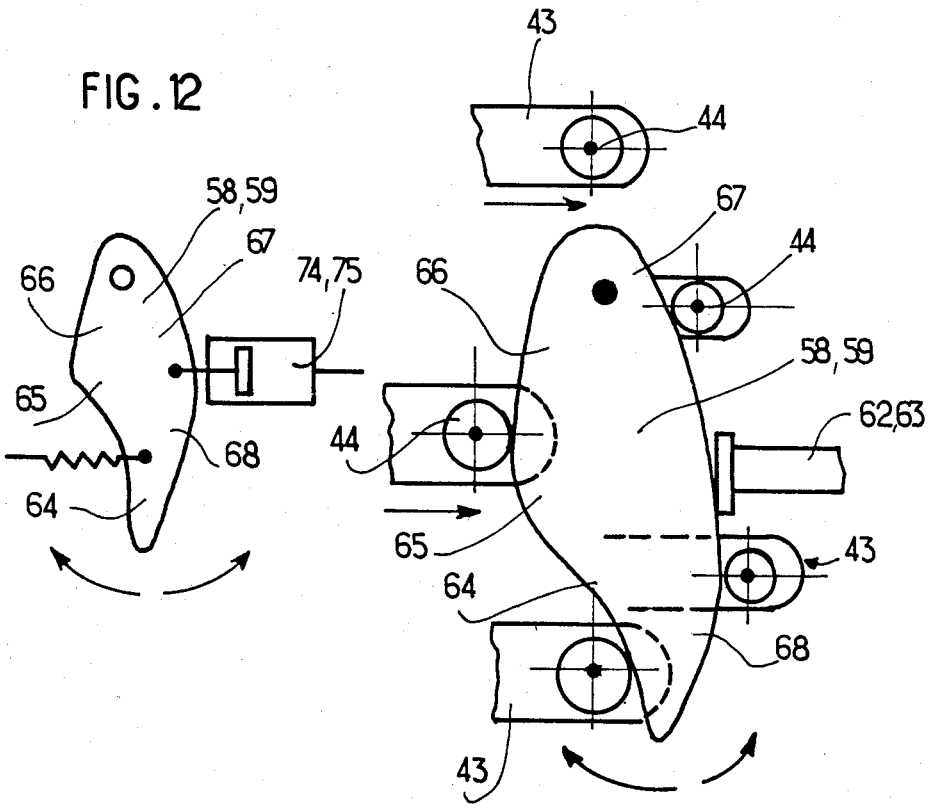
FIG. 12 is a schematic view of one of the cams.
Figure 13:
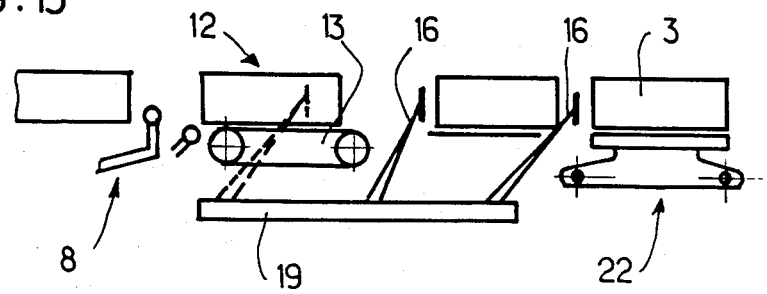
FIGS. 13 to 16 are schematic views illustrating the principal operational configurations according to the different respective positions of the package: admission and horizontal trajectory of the package, ascent of the platform after loading, opening of the trap door and upward push, holding at the hooping level, hooping and discharge by lateral disengagement from the head of the pile.
Figure 14:
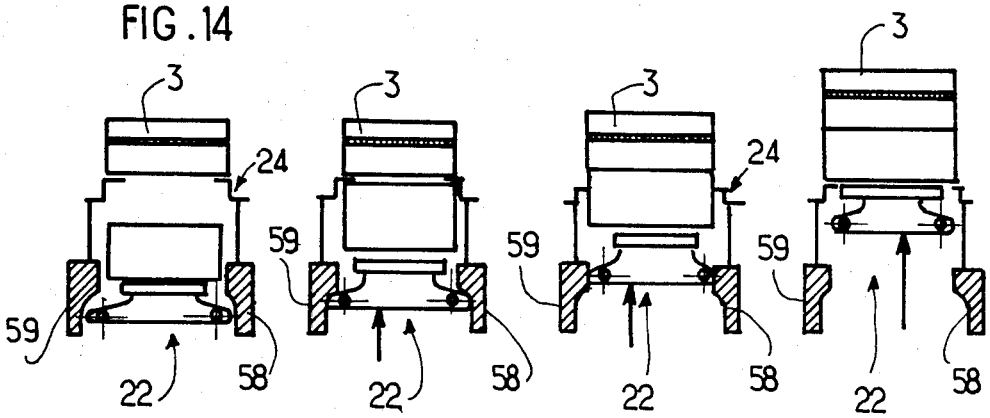
Figure 15:
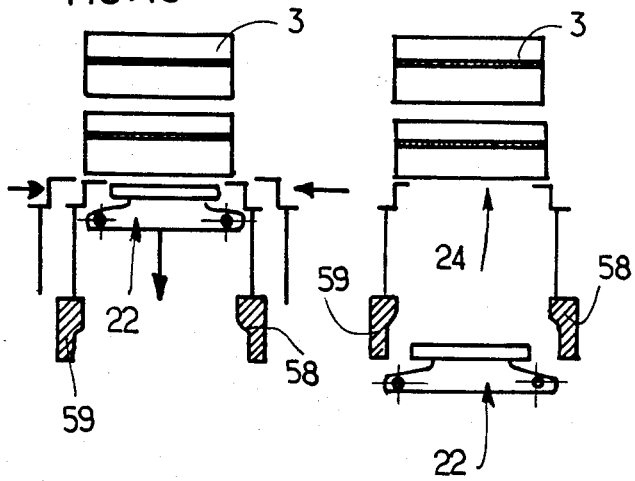
Figure 16:
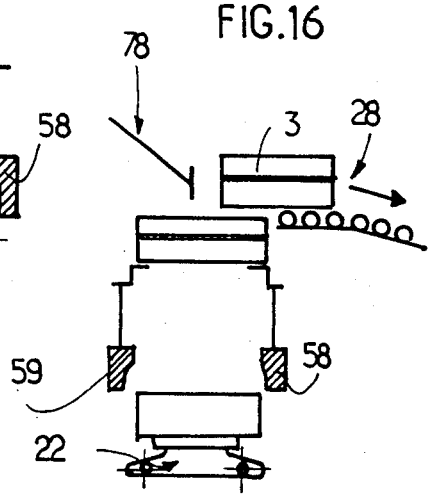

The cams 58 and 59 shown in greater detail in FIG. 12 are mounted so as to have elastic recoil capability with respect to the platform, each being limited in an opposite excursion by respective adjustable end stops 62 and 63. Their cam profile is quasi-symmetrical and has in general a lozange-shaped contour, defining the movement locus of the corresponding stub, which passed around the perimiter during an operative cycle. Each cam defines, as seen from below to above, a subtantially upright wall engagement surface 64, a ramp-like positioning surface 65, and a position-stabilizing surface 66. The return-travel contour is only formed with an inclined ramp surface 67, and a vertical surface 68.

A shield 69 protects the rolling movement path from dust accumulation or from impurities. Each extremity of each cam is provided with, and hugged by respective metallic wings 70 and 71, which pass ahead of an inductive detector such as 72 or 73, which, in turn, deliver validation signals authorizing continuance of the operation.

The stubs 44 and 45, which are provided on respective extremities of the spacing bar 43 roll along the substantially upright engagement surface 64, triggering a light hugging thereof up to the stop. The stub thereafter travels along, and is pushed by the sloped horizontal position-controlling surface 65. Its travel-displacement is completed when it has reached the end of that position-controlling surface, and it is now sufficient to just maintain its displacement. This function is carried out by the position-stabilizing surface 66. The trap door opens and stays open for the passage of the package. After the bottom of the package has crossed the plane of the trap door, the latter is closed abruptly due to the action of the pneumatic push elements and 61.

After the stubs have passed lightly over the tip of the cam, they roll in a downward direction along the opposite surface of the cam, due to the approaching movement of the jaws. The cam simply pivots without influencing the position of the jaws.

Furthermore, each of the cams 58 and 59 is connected to a respective auxiliary security member 74 or 75 controlled by the passage detector 21 on the take-up table 14 across the automatic programming means.

It is the purpose of these security members to slightly pivot the cams 58 and 59 in the absence of any package on the take-up table 14, so as to release the cams from contact with the stubs 44 and 45, and so to avoid any inadvertent opening of the trap door, charged with the task of not providing any support for any package.

These cams permit transferring control of the platform movement to the movements of the jaws, so as to ensure a good coordination of the basic operations of the hooping station, according to the invention.

In this manner, the ascending platform triggers opening of the jaws, and the start of its descent controls closure, so as to ensure maintenance of the hooping device in position, from the time it is positioned by the platform to the level required by the plane of the hooping device.

The package 3 is maintained by the trapdoor in the plane of the arc 25, which forms an integral part of a projection style hooping device 26 of a known type and which has been developed to operate in a vertical plane; this hooping device was provided with the necessary modifications needed for it to adapt to a position of the hooping strap in a horizontal plane. In this manner the chamber employed for strap storage is disposed horizontally, and the device which detects the need for replenishment and controls supply can no longer operate by gravity. A new device providing the same effects and results is furnished to the storage chamber.

For specific applications, particularly for positioning the strap in deformable recesses provided along ridges of the package, different accessories can be added to the arc 25. For example, an assembly of grilles or convergent plates 76 and 77 serves substantially to guide the strap in a secure manner and at a great velocity up to the vicinity of the package sides so as to assure a precise alignment and positioning determined by the shape and level of the grooves formed in the ridges of the package. The shape and length of these plates depend on the form of the packages to be hooped.

After hooping the packages are discharged in a vertical progression and freed by lateral push with the aid of a discharge device 27 on the exit ramp 28, which passes them to the discharge transporter 31 after having passed the exit port 29 and its optical detector 30.

More precisely, the upper part of the upward travel and holding assembly 23 carries the push-operable discharge device 27. One possible embodiment of the latter includes a push arm 78 extendable to the front contact plane 79. This arm is pivotably mounted about a point 80. Its composite to and fro movements downwardly and upwardly come about from the translatory stroke of the support piece 81 in cooperation with the cam pivotably mounted near an extremity of the push arm.

It is the purpose of this arm to disengage the hooped package from the pile, by causing it to scrape the upper face of the following package, and to place it onto the slightly inclined exit ramp 28.

A detector, for example an optical detector 83 furnishes information relating to the presence or absence of successive of the diverse hooped packages which constitute momentarily, and prior to the discharge, the head of the pile.

It is important to note, at this stage, that the hooping is practiced on the central package of a pile incessantly renewing itself during operation by the arrival of a new package arriving from below. Dead times are thus reduced to a minimum.

As already indicated, all movements of the mechanical members are derived from a sole central motor which entrains by suitably adapted transmissions the principal shaft 42, a cam shaft, and a return entrainment device of the discharge mechanism.

The principal shaft 42 carries the cam 41, a disc 84, its kinematic entrainment with the motor, and the diverse mechanical engagement mechanisms for entrainment.

The disc 84 carries on a surface point thereof an articulated and adjustable crank mechanism 85, having a push rod 86 driving the reciprocally movable slider 19 of the to and fro moving mechanism 18, which, in turn, entrains the push arms 16 of the supply mechanism 12, and the reciprocal to and fro movements.

The cam shaft carries cams having metallic sectors which move one after the other in front of an induction-type detector.

These deliver validation and command signals, relating to performance of different elementary operations constituting a functional cycle, to automatic means programmed to direct the operation of the hooping station. Synchronization of the various movements and reliability of operation is therefore perfectly assured.

The hooping station, according to the invention, furthermore includes a rapidly acting hooping band extraction mechanism for replacing the hooping band in the event of any failure thereof. This mechanism includes a chassis truly transversely movable with respect to the main frame up to the maximum deposit. Its manipulation is made possible by hooks. Furthermore, the electrical implemenation results in a rapid grip. All instrumentalities are joined to assure a rapid replacement of the hooping strap.

The different operational phases of the hooping station, according to the invention, are explained hereinafter, by referring more particularly to FIGS. 11–16.

The first phase includes the horizontal transport of the packages. The packages 3 are transported by means of the upstream conveyor belt and transport rollers in a continuous train 4 up to the entry port 7. The barrier device 8 subdivides this train into individual separate packages. The transverse roller 10 descends so as to release the package at the end of the train, which, upon entrainment of the conveyor belt and transport rollers advances just up to the transfer belt 13, which, in turn, transports it up to the center of the take-up table 14, which constitutes the push ramp of the supply assembly 12.

The retractable retention element 9 of the barrier mechanism is made to abut the extremities of the released package so as to block the following package.

The package entrained by the transfer belt 13 arrives on the take-up table 14, upon which it glides up to the central position.

The push arm 16, after extension and passage below the package, assumes an operating position and abuttingly establishes contact with the package along the table 14 up to its loading onto the platform 22, which at that time, is in the lower position and in perfect alignment with the take-up table 14.

The detector 21, which is disposed at one extremity of the take-up table 14, cancels the "rise" command given to the platform 22, if the extremity of the package or its passage is not detected by its capture mechanism. The platform therefore remains immobile. The security members 74 and 75 hug the displacement cams so as to yield upon engagement of the studs of the spacing bar, and opening of the trap door does not take place. Now follows the second phase covering the ascent of the packages.

In the opposite case, after validation of the signals from the detector 21 and complete loading of the package onto the platform, that platform is made to ascend, and a succession of movements is generated in accordance with the operating cycle of the hooping station according to the program introduced into the automatic means.

The ascent of the platform triggers the separation of the jaws of the stabilizing trap door portion 24 at the time when the studs of the spacing bar 43 make contact with the horizontal position-controlling surfaces 65 of the cams 58 and 59.

Disengagement between the upper face of the packages and the level of the studs where the disengagement separation points on the cams is such that opening of the jaws of the trap door 24 takes place only at a moment in time when the upper face of an arriving package touches, or is about to touch the bottom of an already hooped package. The downstream package, already hooped, yields easily.

The package to be hooped continues on its ascension path past the open trap, up to the hooping position in the interior of the arc 25, by pushing the bottom of the already hooped package upwardly, that bottom resting entirely on the package still to be hooped. At the end of the movement, the package to be hooped is in the hooping position, and the already hooped package in the discharge position occupying a top place on the pile and the trap door is closed below the bottom of the package to be hooped. The new package is loaded, or rather deposited on the trap door by retraction of the platform.

Thereafter, hooping takes place from the moment of stabilization of the end movement. The upper package is discharged at the same time by being pushed towards and onto the discharge ramp 28 by means of a discharge device. The security detector 28 takes note of the passage of the hooped package during its discharge.

During this time, a new package led and loaded onto the platform moves towards the trap door.

Following the return stroke of the push arm of the discharge device, the new package comes into contact with the bottom of the newly hooped package, and lifts it from its hooping position past the trap door and the arc section to its discharge position.

The jaws open following contact between the two packages and become immobilized at closure below the new package.

There follows the discharge phase of the newly circled package. The latter is discharged in the same manner to the station's exterior.

The entire operation of this round of packages will thus be understood to include reloading from the bottom, hooping and empilement, and discharge from the top, by simple lateral disengagement from the pile. In fact, these characteristics permit control of all transfers, and in this manner it is particularly possible to improve the rate of hooping, which can exceed a limit of thirty operations per minute resulting solely from the performance limitation of the hooping device itself.

It is worth noting that the hooping operation takes place in continuous succession during transfer and arrival of a new package, and during discharge of the downstream and already hooped package, without any dead time whatsoever.

We claim:

1. An automatic high speed hooping station for horizontal hooping of diverse packages characterized by it being composed in the sense of the direction of travel of the packages (3) of a barrier device (8) to effect their entry, one by one, followed by a conveyance assembly (12) constituted by a rolling double transfer belt (13) followed by a take-up table (14) provided with an optical detector (21) at its extremity, along which there moves reciprocally a push- and loading-device (15) for the introduction thereof into an upward travel and holding assembly (23) formed by an ascending platform (22), a holder trapdoor (24) in a hooping position in an arc (25) of a hooping device (26), and an upper package discharge device (27) operating by lateral disengagement from a pile of the packages onto an exit ramp, the discharge device (27) including a push arm (78) articulatably mounted around a point (80) actuated by a cam (82), the assembly being movable in translation under the surveillance of a detector (83).

2. A station according to claim 1, characterized by the reciprocally movable push- and loading-device (15) being an extendable arm (16) terminated by a push plate (17) movable between the movable belts and along the central groove of the take-up table (14).

3. A station according to claim 1, characterized by the platform (22) being mounted for translatory movement along guide shafts (36) and (37) by movable shafts (33) and (34), the extremities of which are joined by a junction plate (38) articulatably connected by a link (39) to a pivotable arm (40), the platform (22) comprising a thick base which is solid with a spacing bar (43) provided on its extremities with stubs or pins (44) and (45), which cooperate with opening means in the trap door.

4. A station according to claim 3 characterized by the trap door (24) comprising on its extremities members capable of supporting the package in the hooping position, pieces extended by two jaws (46) and (47) movably mounted along two guide shafts (48) and (49), which carry on their lower extremities position-controlling cams (58) and (59), which cooperate with the stubs or pins (44) and (45) of the spacing bar (43), the jaws being urged to a closure position by push-means (60) and (61).

5. A station according to claim 4 characterized by the cams (58) and (59) being articulatably mounted with elastic recoil capability towards the platform, each being limited in an opposite excursion by a respective adjustable stop (62) and (63), their profile being generally lozenge-shaped, and being constituted from below to above by a substantially upright engagement surface (64), a position-controlling ramp-surface (65), and a holding surface (66), the opposite return surface including an inclined ramp portion (67) and an upright portion (68).

6. A station according to claims 4 characterized that each cam extremity is formed with an extension passing in front of a respective induction detector (72) and (73).

7. A station according to claim 4 characterized by each cam (58) and (59) being connected to a respective auxiliary security member (74) and (75) hugging the cam for disengaging the stubs (44) and (45) therefrom.

8. A station according to claim 4 characterized by the displaceable stops (52) and (53) being mounted on the guide shafts (48) and (49) so as to define a stop-and closure-point of the jaws, and the spacing between the support members of the trap door, a median cross-bar (57) maintaining a longitudinal format (56) equal to that of the spacing between the support members of the trap door in the closed position.

9. A station according to claim 1, characterized that the barrier device, the pushing mechanism, the platform (22), the trap door (24), and the discharge device (27) are energized by a sole motor entraining a principal shaft (42) integral with a reciprocally moving mechanism having a crankshaft and an L-shaped pivotable arm (40) in abutting engagement with a cam (41) mounted on the principal shaft (42), and being kinematically connected to a mechanical command mechanism of the push arm of the discharge device (27), and to a cam shaft (83) for synchronizing the movements.

10. A method for continuous automatic horizontal hooping at high speed, characterized that a package is introduced from below into an arc of a hooping device on an ascending platform, that a holding trap is opened by the platform, that the package is emplaced for hooping by the platform, that the trap door is closed by external push means, that the package is supported by the trap, that the platform is lowered, that hooping is performed during the descent and loading of the platform, that a new package is supplied to the platform, that the trap door is opened by the ascending movement of the platform, and that when the upper face of the package appears on the support elements of the trap door, or below the bottom of the preceding package, that that preceding package is pushed upwardly across the trap door by the arriving package, that the new package is lifted above the plane of the trap door by the platform, that the trap door is closed, that the platform is made to descend to a lower position, that hooping is carried out during discharge of the previous package towards a discharge ramp by lateral disengagement from the pile with the aid of a pushing device, that simultaneously with the hooping operation the platform is loaded and thereafter made to ascent towards the trap door for a new operative cycle.

* * * * *